US007348731B2

(12) United States Patent
Haacke et al.

(10) Patent No.: US 7,348,731 B2
(45) Date of Patent: Mar. 25, 2008

(54) HIGH-PRESSURE GAS DISCHARGE LAMP WITH AN ASYMMETRICAL DISCHARGE SPACE

(75) Inventors: Michael Haacke, Aachen (DE); Pieter Postma, Roosteren (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 82 days.

(21) Appl. No.: 10/539,693

(22) PCT Filed: Dec. 9, 2003

(86) PCT No.: PCT/IB03/05777

§ 371 (c)(1),
(2), (4) Date: Jun. 16, 2005

(87) PCT Pub. No.: WO2004/057645

PCT Pub. Date: Jul. 8, 2004

(65) Prior Publication Data

US 2006/0255742 A1 Nov. 16, 2006

(30) Foreign Application Priority Data

Dec. 20, 2002 (EP) ..... 02102868

(51) Int. Cl.
*H01J 17/20* (2006.01)

(52) U.S. Cl. ..... 313/641; 313/634

(58) Field of Classification Search ..... 313/568, 313/570, 573, 572, 634, 637, 641
See application file for complete search history.

(56) References Cited

U.S. PATENT DOCUMENTS 4,935,668 A * 6/1990 Hansler et al. ..... 315/82
5,402,037 A 3/1995 Irisawa et al.
6,815,889 B2 * 11/2004 Haacke et al. ..... 313/573

FOREIGN PATENT DOCUMENTS

| | | | |
|---|---|---|---|
| DE | 2746671 | A | 4/1978 |
| EP | 0338637 | A2 | 10/1989 |
| EP | 0483507 | A2 | 5/1992 |
| EP | 0483507 | B1 | 5/1992 |
| EP | 0 581 359 | A1 | 2/1994 |
| EP | 0982760 | A2 | 3/2000 |
| EP | 0982760 | B1 | 3/2000 |
| EP | 1150337 | A2 | 10/2001 |
| EP | 1315197 | A1 | 5/2003 |

* cited by examiner

*Primary Examiner*—Joseph L Williams

(57) ABSTRACT

A high-pressure gas discharge lamp (HID [high intensity discharge] lamp) is described which is in particular free from mercury and suitable for use in automobile technology. The lamp is remarkable in particular for a discharge space (2) which has a volume which is reduced by a given factor in comparison with the volume of the discharge space of known mercury-containing discharge lamps. The quantity of the light-generating substances in the discharge space (2) is reduced by the same factor in the simplest case, or even more strongly. This avoids the risk of an impairment of the imaging properties of the lamp because of non-evaporated light-generating substances which may shade off a portion of the luminous discharge arc (21) and/or the tips of the electrodes (3).

17 Claims, 1 Drawing Sheet

HIGH-PRESSURE GAS DISCHARGE LAMP WITH AN ASYMMETRICAL DISCHARGE SPACE

Figure 1:
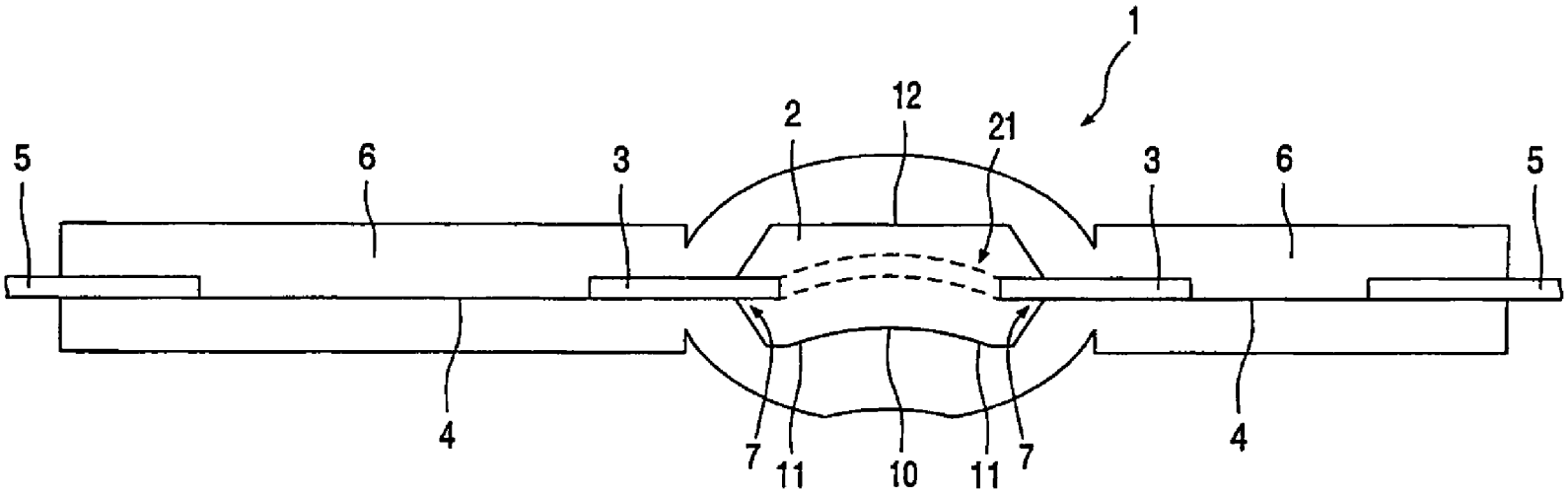

The invention relates to a high-pressure gas discharge lamp (HID [high intensity discharge] lamp) which is in particular free from mercury and suitable for use in automobile technology.

Conventional high-pressure gas discharge lamps usually contain in addition to a starter gas on the one hand a discharge gas (for example a metal halide such as sodium iodide or scandium iodide), which represents the actual light-emitting material (light generator), and on the other hand mercury, which serves primarily as a voltage gradient former and has the essential function of promoting the evaporation of the light-generating substances through a rise in temperature and pressure and of raising the luminous efficacy and burning voltage of the lamp.

Lamps of this kind have come into widespread use because of their good photometric properties, and they are increasingly used also in automobile technology. An additional requirement made in a number of cases in particular for this application is that the lamps should contain no mercury for environmental reasons.

The problems related to an omission of mercury are essentially that a lower operating voltage and accordingly a higher lamp current and a lower luminous efficacy are obtained for a given lamp power in continuous operation, unless measures are provided for at least partly taking over the functions of the mercury mentioned above.

Thus it is known, for example, from EP 0 581 359 to offset the pinches of the discharge lamp with respect to the axis of the discharge space in a direction to the lower wall thereof so as to reduce the temperature differences between the wall portions of the discharge space which are in uppermost and lowermost position in the operational state, so that in this manner the distance between the electrode tips and the lower wall is reduced. This publication, however, relates to a discharge lamp that contains mercury.

It was found that such a change is capable of raising the operating voltage and luminous efficacy in a mercury-free lamp. This change, however, may also have the result that the non-evaporated substances in the discharge space, in particular the light-generating salts accumulating on the lower wall of the discharge space, adversely affect the imaging properties of the luminous discharge arc after switching-on of the lamp in that said salts migrate towards the electrode tips and partly obscure said tips or the luminous discharge arc.

It is accordingly an object of the invention to provide a high-pressure gas discharge lamp with a discharge space whose inner shape has been changed ("asymmetrical discharge space"), for example for achieving a substantially homogeneous temperature distribution in accordance with the above explanation, wherein the danger of an impairment of the imaging properties by non-evaporated substances in the discharge space is at least substantially eliminated.

The invention also has for its object to provide a high-pressure gas discharge lamp in which the risk of an impairment of the imaging properties by non-evaporated substances in the discharge space is at least substantially eliminated in particular in the case in which the electrodes and the discharge space are mutually asymmetrically arranged ("asymmetrical discharge vessel"), i.e. at least the electrode tips are at a smaller distance from a bottom wall surface of the discharge space than from the upper wall thereof (always in the operational position of the lamp).

Finally, it is an object of the invention to provide in particular a mercury-free high-pressure gas discharge lamp which has an asymmetrical discharge space and/or an asymmetrical discharge vessel for achieving a desired luminous efficacy and operating voltage, without giving rise to the risk that substances that are not evaporated in the operational state of the lamp partly or wholly obscure the discharge arc or the electrodes and thus detract from the imaging properties.

According to an embodiment, the object is achieved by means of a high-pressure gas discharge lamp with an asymmetrical discharge space and/or an asymmetrical discharge vessel, wherein the discharge space has a volume which is reduced by a given first factor in comparison with the volume of the discharge space of known mercury-containing discharge lamps, and wherein an obscuration of portions of the luminous discharge arc and/or of portions of the electrodes by light-generating substances not evaporated in the operational state is prevented in that the quantity of the light-generating substances in the discharge space is reduced by a second factor which is determined in dependence on the value of the first factor and on the distance, defined by the asymmetry, of the electrodes to a bottom surface that is lowermost in the operational position of the lamp.

The starting point here is that the volume of the discharge space of a known mercury-containing discharge lamp, for example in accordance with U.S. Pat. No. 5,402,037, lies between 20 μl and 50 μl.

It is furthermore assumed that a discharge lamp usually contains a gas filling in which the light-generating substances are present in an at least slightly oversaturated quantity, so that also in the operational state these substances do not fully enter the gas phase, but a portion thereof remains in solid or liquid form on the bottom of the discharge space. A reservoir of light-generating substances is thus maintained in the lamp, with which any losses through diffusion are made up and lamp life is prolonged.

A particular advantage of this solution is that an increase in the luminous efficacy and operating voltage can be achieved while the imaging properties remain the same in discharge lamps containing mercury and in those that are free from mercury in a simple and reliable manner.

The dependent claims relate to advantageous further embodiments of the invention.

One embodiment of the present solution is provided in particular for use in automobile technology.

In other embodiments, a mercury-free discharge lamp with particularly good imaging properties is provided, while further embodiments have an enhanced luminous efficacy and operating voltage for a mercury-free gas filling.

Further details, features, and advantages of the invention will become apparent from the ensuing description of preferred embodiments, which is given with reference to the drawing, in which:

FIG. 1 is a diagrammatic longitudinal sectional view of such an embodiment.

FIG. 1 diagrammatically shows the construction of a first high-pressure gas discharge lamp according to the invention. The lamp of FIG. 1 comprises a discharge vessel 1 of quartz glass, which encloses a discharge space 2. The discharge space 2 is bounded inter alia by a bottom surface 11, 12 which is in lowermost position in the operational position of the lamp and by an upper wall 12 opposite to the former.

The free, first ends of electrodes 3, made from a material of as high as possible a melting temperature such as, for example, tungsten, extend into the discharge space 2 from its mutually opposed ends. The second ends of the electrodes 3 are each fastened to an electrically conducting tape or foil 4, in particular a molybdenum foil, through which again an electrical connection is achieved between connection terminals 5 of the discharge lamp and the electrodes 3.

To safeguard a vacuumtight entry of the electrodes 3 into the discharge space 2, the discharge vessel 1 merges into quartz glass portions (pinches or metal-quartz lead-throughs) 6 in the entry locations, wherein the second ends of the electrodes 3, the electrically conducting foil 2, and portions of the connection terminals 5 are embedded.

An arc discharge 21 (luminous arc) is excited between the tips of the electrodes 3 when the lamp is in the operational state.

The discharge space 2 is filled with a gas which comprises a discharge gas (light generator) that emits the light radiation through excitation and discharge as well as preferably a voltage gradient former, which may both be chosen from the group of metal halides.

The light-generating substances are, for example, sodium iodide and/or scandium iodide, while the voltage gradient formers that may be used instead of mercury are, for example, zinc iodide and/or other substances, in particular one or several metal halides.

Since the substances used as a replacement for mercury have a comparatively low partial vapor pressure, however, it is necessary to change the temperature balance in the discharge vessel 1 so as to achieve substantially the same luminous efficacy as with the use of mercury, i.e. substantially the same luminous flux, as well as an operating voltage which is as high as possible.

This change in the temperature balance can be achieved with the interior shape of the discharge space 2 shown in FIG. 1. As is apparent from the Figure, the bottom surface 10, 11 in lowermost position in the operational state (which normally has the lowest temperature in the operational state of the lamp) has a raised central first portion 10 which is surrounded by relatively lowered second portions ("pockets") 11. The first portion 10 has a comparatively small distance to the luminous arc 21 that is formed during operation. This distance should preferably be smaller than the distance between the luminous arc 21 and the upper wall 12 of the discharge space 2.

This measure at the same time reduces the volume of the discharge space by a first factor in comparison with the volume of the discharge space of known mercury-containing discharge lamps, which factor is defined by the shape of the bottom surface 10, 11.

The measure described above achieves that the temperature of the light-generating substances that have accumulated in the solid state on the first portion 10 with the lamp being switched off is raised so far that said substances enter the gaseous state in a sufficient quantity for achieving a desired, i.e. as high as possible luminous efficacy and burning voltage in continuous operation.

It is possible with the raised first portion 10 of the bottom surface in particular to achieve a luminous efficacy of the lamp as could hitherto be achieved substantially only with gas fillings containing mercury. Furthermore, the spectral properties and the color point of the generated light correspond substantially to those of lamps containing mercury, which is of particular importance for the application in automobile technology.

The burning voltage of the lamp is also raised thereby in comparison with known mercury-free lamps.

In addition, the temperature of the hottest spot of the discharge vessel 1, which is usually present on the opposite side, at the upper wall 12, is not raised any further, so that also the maximum thermal load on the lamp is not increased and in particular a lumen maintenance comparable to that of mercury-containing discharge lamps is achieved.

The rise in temperature of only the first portion 10 of the bottom surface also achieves, finally, that the temperature gradient along the wall of the discharge vessel 1, in particular between the upper and lower sides thereof, is reduced, so that also the thermal stresses in the vessel are substantially smaller.

It should indeed be safeguarded here that, after switching-on of the lamp, the light-generating substances or other substances not yet evaporated do not cover the electrode tips or the discharge arc 21, including the diffuse region thereof, because the imaging properties of the lamp are impaired thereby.

It should furthermore be heeded that the light-generating substances accumulated on the bottom surface 10, 11 cannot reach the entry locations 7 of the electrodes 3, and thus the pinches 6, owing to the temperature rise occurring during switching-on of the lamp and the resulting migration of these substances, because they could cause damage through corrosion or similar effects there in the course of time.

This is achieved according to the invention in that the quantity of the light-generating substances in the discharge space is reduced by a second factor which is determined in dependence on the value of the first factor mentioned above and on the distance of the electrodes to the bottom surface 10, 11, in particular the first portion 10 thereof, which distance follows from the asymmetry.

At the same time, however, the quantity of the light-generating substances should remain so large that they are never fully evaporated also in the operational state of the lamp (oversaturation), so as to create a reservoir in this manner for dealing with diffusion losses and for prolonging lamp life.

An example will now be given below based on a usual symmetrical discharge vessel or symmetrical discharge space which has a volume of 27 μl and contains 300 μg of light-generating substances.

When the volume of the discharge space is reduced to approximately 18 μl in the case of a mercury-free gas filling, and the first portion 10 in the embodiment shown in FIG. 1 is raised by approximately 1 mm with respect to the second portions 11, particularly advantageous imaging properties are obtained when the quantity of light-generating substances is reduced to approximately 200 μg. A reduction in luminous efficacy and burning voltage that may arise can be compensated through the addition of rare gas, in particular xenon, in the discharge space 2, i.e. an increase in the xenon pressure. Experiments have shown that a rise in the xenon cold pressure of approximately 10 bar to approximately 13 bar renders it possible to raise the luminous efficacy by approximately 5%. It was further found that a rise in the xenon pressure of this order of magnitude does not have an appreciable effect on the imaging properties of the luminous discharge arc 21.

It is accordingly possible with the invention to realize in particular a mercury-free discharge lamp through the reduction of the volume or change of the discharge space 2 as described above with substantially the same luminous efficacy and burning voltage as with mercury-containing discharge lamps, while it is only necessary to reduce the quantity of the light-generating substances in the manner described so as to safeguard unchanged imaging properties.

The principle of the invention is obviously also applicable to mercury-containing discharge lamps and in general to those discharge lamps in which the volume is not reduced.

The invention claimed is:

1. A high-pressure discharge lamp with an asymmetrical discharge space and/or an asymmetrical discharge vessel, wherein a bottom surface that is lowermost in an operational position of the lamp has a raised central first portion which is surrounded by a relatively lowered second portion, whereby the discharge space has a volume which is reduced by a given first factor in comparison with the volume of the discharge space of known mercury-containing discharge lamps, and wherein an obscuration of portions of a luminous discharge arc and/or of portions of electrodes by light-generating substances not evaporated in an operational state is prevented in that a quantity of the light-generating substances in the discharge space is reduced by a second factor which is determined in dependence on a value of the first factor and on a distance, defined by the asymmetry, of the electrodes to the bottom surface that is lowermost in the operational position of the lamp, and wherein the volume of the discharge space is approximately 18 μl.

2. The high-pressure discharge lamp as claimed in claim 1, wherein the discharge space does not contain mercury.

3. The high-pressure discharge lamp as claimed in claim 1, wherein the quantity of light-generating substances is approximately 200 μg.

4. A high-pressure discharge lamp as claimed in claim 1, wherein the bottom surface comprises a first portion which is raised by approximately 1 mm with respect to a surrounding second portion.

5. The high-pressure discharge lamp as claimed in claim 1, wherein the discharge space contains a rare gas.

6. The high-pressure discharge lamp as claimed in claim 1, wherein the discharge space contains xenon with a xenon cold pressure of between approximately 8 bar and approximately 20 bar.

7. A lighting unit with a high-pressure gas discharge lamp as claimed in claim 1.

8. The high-pressure discharge lamp as claimed in claim 1, wherein the discharge space contains xenon with a xenon cold pressure of between approximately 10 bar and approximately 15 bar.

9. A high-pressure discharge lamp with an asymmetrical discharge space and/or an asymmetrical discharge vessel, wherein a bottom surface that is lowermost in an operational position of the lamp has a raised central first portion which is surrounded by a relatively lowered second portion, whereby the discharge space has a volume which is reduced by a given first factor in comparison with the volume of the discharge space of known mercury-containing discharge lamps, and wherein an obscuration of portions of a luminous discharge arc and/or of portions of electrodes by light-generating substances not evaporated in an operational state is prevented in that a quantity of the light-generating substances in the discharge space is reduced by a second factor which is determined in dependence on a value of the first factor and on a distance, defined by the asymmetry, of the electrodes to the bottom surface that is lowermost in the operational position of the lamp.

10. The high-pressure discharge lamp as claimed in claim 9, wherein the discharge space does not contain mercury.

11. The high-pressure discharge lamp as claimed in claim 9, wherein the volume of the discharge space is approximately 18 μl.

12. The high-pressure discharge lamp as claimed in claim 9, wherein the quantity of light-generating substances is approximately 200 μg.

13. The high-pressure discharge lamp as claimed in claim 9, wherein the bottom surface comprises a first portion which is raised by approximately 1 mm with respect to a surrounding second portion.

14. The high-pressure discharge lamp as claimed in claim 9, wherein the discharge space contains a rare gas.

15. The high-pressure discharge lamp as claimed in claim 9, wherein the discharge space contains xenon with a xenon cold pressure of between approximately 8 bar and approximately 20 bar.

16. A lighting unit with a high-pressure gas discharge lamp as claimed in claim 9.

17. The high-pressure discharge lamp as claimed in claim 9, wherein the discharge space contains xenon with a cold pressure of between approximately 10 bar and approximately 15 bar.

* * * * *